US009352443B2

(12) United States Patent
Suen et al.

(10) Patent No.: US 9,352,443 B2
(45) Date of Patent: May 31, 2016

(54) PLATEN ASSEMBLY, CHEMICAL-MECHANICAL POLISHER, AND METHOD FOR POLISHING SUBSTRATE

(71) Applicant: Taiwan Semiconductor Manufacturing CO., LTD., Hsinchu (TW)

(72) Inventors: Shich-Chang Suen, Hsinchu (TW); Chin-Hsiang Chan, New Taipei (TW); Liang-Guang Chen, Hsinchu (TW); Yung-Cheng Lu, Hsinchu (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 255 days.

(21) Appl. No.: 14/078,999

(22) Filed: Nov. 13, 2013

(65) Prior Publication Data

US 2015/0133033 A1 May 14, 2015

(51) Int. Cl.

| | |
|---|---|
| ***B24B 37/34*** | (2012.01) |
| ***B24B 49/12*** | (2006.01) |
| ***B24B 37/20*** | (2012.01) |
| ***B24B 37/005*** | (2012.01) |
| ***B24B 37/10*** | (2012.01) |
| ***B24B 49/10*** | (2006.01) |
| ***B24B 37/26*** | (2012.01) |

(52) U.S. Cl.

CPC ..... *B24B 37/34* (2013.01); *B24B 37/005* (2013.01); *B24B 37/105* (2013.01); *B24B 37/205* (2013.01); *B24B 37/26* (2013.01); *B24B 49/105* (2013.01); *B24B 49/12* (2013.01)

(58) Field of Classification Search

CPC ..... B24B 37/34; B24B 49/12; B24B 37/10; B24B 49/10; B24B 37/20; B24B 37/005

USPC ..... 451/11, 60, 53, 41, 488, 450, 446, 451/526–539, 6

See application file for complete search history.

(56) References Cited

U.S. PATENT DOCUMENTS

| | | | | | |
|---|---|---|---|---|---|
| 5,246,525 | A * | 9/1993 | Sato | B24B 37/04 | 156/345.12 |
| 5,658,185 | A * | 8/1997 | Morgan, III | B24B 57/02 | 438/693 |
| 6,056,851 | A * | 5/2000 | Hsieh | B24B 57/02 | 156/345.12 |
| 6,599,175 | B2 * | 7/2003 | Herb | B24B 37/16 | 451/287 |
| 6,652,366 | B2 * | 11/2003 | Dyer | B24B 57/02 | 451/287 |
| 6,705,928 | B1 * | 3/2004 | Barns | B24B 37/26 | 451/285 |
| 6,951,597 | B2 * | 10/2005 | Korovin | B24B 37/16 | 156/345.13 |
| 7,314,402 | B2 * | 1/2008 | Laursen | B24B 37/26 | 451/285 |
| 7,438,795 | B2 * | 10/2008 | Wylie | B24B 37/26 | 204/212 |
| 2002/0173231 | A1 * | 11/2002 | Hasegawa | B24B 37/013 | 451/6 |

* cited by examiner

*Primary Examiner* — Robert Rose

(57) ABSTRACT

A platen assembly includes a platen body, a polishing pad, and a fountain slurry supplier. The platen body has an upper surface. The polishing pad is disposed on the upper surface of the platen body. The fountain slurry supplier is at least partially disposed on the upper surface of the platen body for supplying slurry up onto the polishing pad.

19 Claims, 3 Drawing Sheets

PLATEN ASSEMBLY, CHEMICAL-MECHANICAL POLISHER, AND METHOD FOR POLISHING SUBSTRATE

BACKGROUND

The current design of a chemical-mechanical polisher generally employs a slurry dispense arm over a platen. Fluid like slurry or chemical is supplied from the slurry dispense arm and deposited on a polishing pad disposed on the platen. To well distribute slurry or chemicals on the polishing pad, the size of the polishing pad and thus the platen must be large enough for the spread of the fluid over the polishing pad. With the increase of a wafer size, the tool size will be geometrically increased, and thus the cost of operation will be inevitably increased.

BRIEF DESCRIPTION OF THE DRAWINGS

The present disclosure can be more fully understood by reading the following detailed description of the embodiment, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
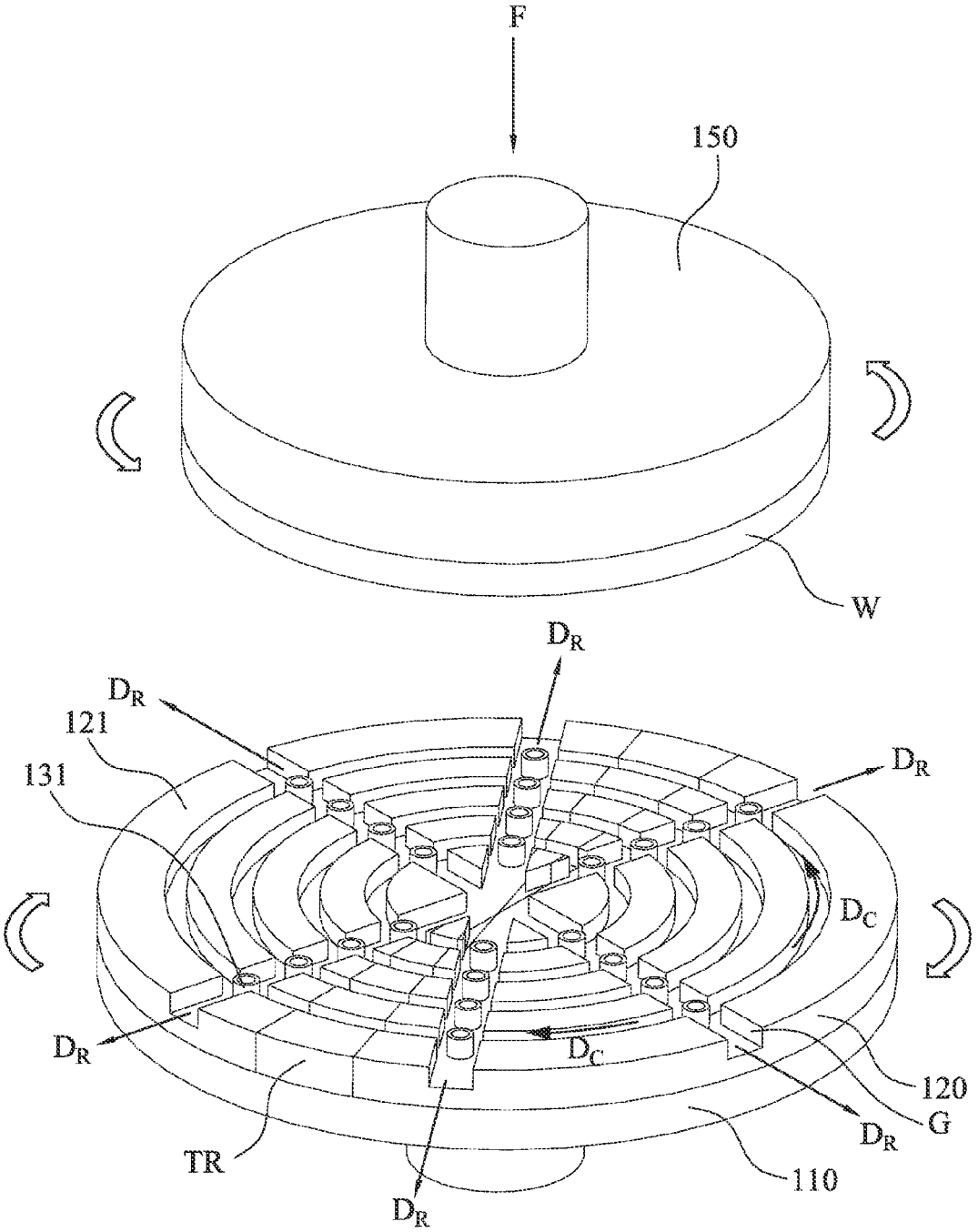
FIG. 1 is a 3-dimensional drawing of a chemical-mechanical polisher according to some embodiments of the present disclosure.
Figure 2:
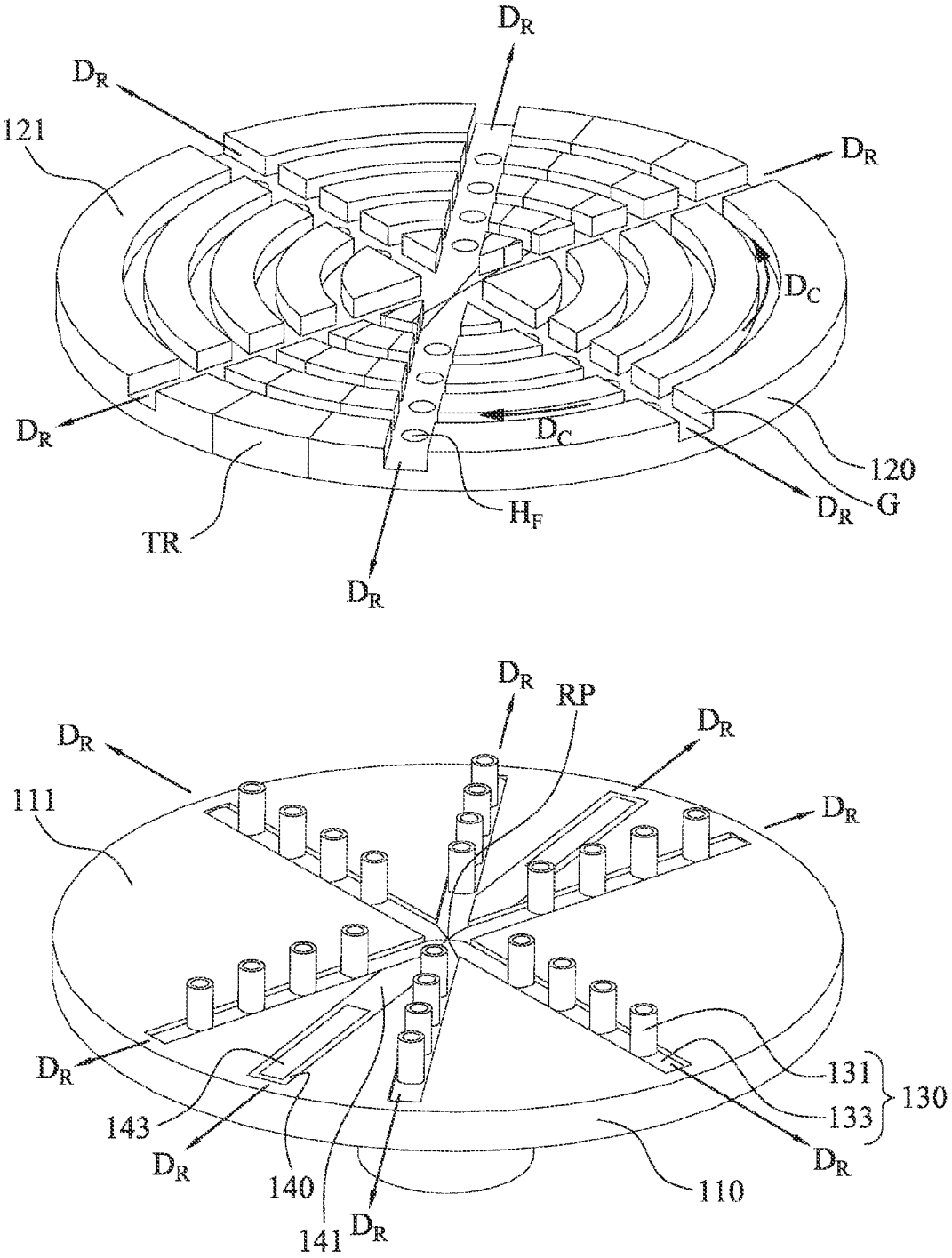
FIG. 2 is an exploded view of a platen body 110 and a polishing pad 120 of FIG. 1.

Chemical-mechanical polishing is a process in which an abrasive slurry and a polishing pad work simultaneously together in both the chemical and mechanical approaches to flatten a substrate, or more specific a wafer. FIG. 1 is a 3-dimensional drawing of a chemical-mechanical polisher according to some embodiments of the present disclosure. FIG. 2 is an exploded view of a platen body 110 and a polishing pad 120 of FIG. 1. As shown in FIGS. 1 & 2, the chemical-mechanical polisher includes the platen body 110, the polishing pad 120, a fountain slurry supplier 130, and a carrier head 150. The platen body 110 has an upper surface 111. The polishing pad 120 is disposed on the upper surface 111 of the platen body 110, and the polishing pad 120 has an upper surface 121 facing away from the upper surface 111 of the platen body 110. Moreover, the fountain slurry supplier 130 is at least partially disposed on the upper surface 111 of the platen body 110 for supplying slurry up onto the polishing pad 120. The carrier head 150 is disposed over the polishing pad 120 for holding a substrate W against the upper surface 121 of the polishing pad 120.

During the operation of the chemical-mechanical polisher, a downward force F is applied to the carrier head 150, pushing the substrate W against the upper surface 121 of the polishing pad 120. At the same time, both the carrier head 150 and the platen body 110 are rotated, and thus both the substrate W and the polishing pad 120 are rotated as well. In addition, the fountain slurry supplier 130 supplies slurry up onto the polishing pad 120. The cooperation between chemically the slurry and mechanically the polishing pad 120 removes material of the substrate W and tends to even out any irregular topography on the profile of the substrate W, making the substrate W flat or planar.

As shown in FIGS. 1 & 2, since the fountain slurry supplier 130 is at least partially disposed on the upper surface 111 of the platen body 110, slurry can be supplied directly up onto the upper surface 121 of the polishing pad 120 by the fountain slurry supplier 130. The mechanism of the fountain slurry supplier 130 to supply the slurry onto the upper surface 121 can allow the slurry to be supplied to a particular point on the upper surface 121. Therefore, with an even allocation of the particular points on the upper surface 121 of the polishing pad 120, through which the slurry is supplied up onto the upper surface 121, an even distribution of the slurry supply over the upper surface 121 of the polishing pad 120 can be achieved. Technically speaking, the even supply of the slurry to the area of the upper surface 121 can substantially facilitate the even distribution of the slurry over the whole area of the upper surface 121 of the polishing pad 120.

The upper surface 111 of the platen body 110 has at least one radial direction $D_R$, and the fountain slurry supplier 130 has a plurality of nozzles 131 arranged substantially along the radial direction $D_R$ of the upper surface 111 of the platen body 110. This arrangement of the nozzles 131 along the radial direction $D_R$ facilitates the even distribution of the slurry over the upper surface 121 of the polishing pad 120 after the slurry is supplied up onto the upper surface 121 of the polishing pad 120.

To be more specific, the nozzles 131 are arranged in at least one radial row relative to a center of the upper surface 111 of the platen body 110. In some embodiments of this disclosure, as shown in FIGS. 1 & 2, the nozzles 131 are arranged in six radial rows relative to the center of the upper surface 111 of the platen body 110, and each row has four of the nozzles 131 arranged therein.

Since the slurry is supplied up onto the polishing pad 120 through the nozzles 131, the even distribution of the slurry over the polishing pad 120 can be practically achieved, unlike the conventional approach where the polishing pad 120 of a large area is used in order to provide an extra area for the slurry to spread out over the upper surface 121 of the polishing pad 120.

As shown in FIG. 1, the substrate W has a polished surface against the upper surface 121 of the polishing pad 120, and an area of the upper surface 121 of the polishing pad 120 substantially satisfies:

$$80\%\ A_{polishing\ pad} \leq A_{substrate} \leq 95\%\ A_{polishing\ pad},$$

where $A_{polishing\ pad}$ is the area of the upper surface 121 of the polishing pad 120, and $A_{substrate}$ is an area of the polished surface of the substrate W. Since it is intended that the area of the polished surface of the substrate W is smaller than the area of the upper surface 121 of the polishing pad 120, the profile control of an edge of the substrate W can be achieved. Moreover, under this condition, the majority of the area of the upper surface 121 of the polishing pad 120 can be substantially utilized for the polishing work on the substrate W. Unlike the conventional approach in which, in a particular moment, less than one fourth of the area of the upper surface 121 of the polishing pad 120 is utilized for the polishing work of the substrate W, while a part of the area of the upper surface 121 of the polishing pad 120 is utilized for the spread of the slurry.

In addition, similarly, the substrate W has a polished surface against the upper surface 121 of the polishing pad 120, and an area of the upper surface 111 of the platen body 110 substantially satisfies:

$$80\% A_{platen\ body} \leq A_{substrate} \leq 95\% A_{platen\ body},$$

where $A_{platen\ body}$, is the area of the upper surface 111 of the platen body 110, and $A_{substrate}$ is the area of the polished surface of the substrate W. In other words, it is intended that both the areas of the upper surface 111 of the platen body 110 and the upper surface 121 of the polishing pad 120 are only slightly larger than the area of the polished surface of the substrate W. Therefore, as compared to the conventional approach, the area size of the upper surface 111 of the platen body 110 is greatly reduced. Consequently, the size of the corresponding chemical-mechanical polisher can also be greatly reduced.

For a particular area size of the polished surface of the substrate W, the area sizes of the upper surface 121 of the polishing pad 120 and the upper surface 111 of the platen body 110 can be minimized to be slightly larger than the substrate W. In some embodiments of this disclosure, for example, when the area size of the substrate W is 300 mm in diameter, the area sizes of the upper surface 121 of the polishing pad 120 and the upper surface 111 of the platen body 110 can be substantially 350 mm in diameter. Similarly, when the area size of the substrate W is 450 mm in diameter, the area sizes of the upper surface 121 of the polishing pad 120 and the upper surface 111 of the platen body 110 can be substantially 500 mm in diameter. Simply speaking, the area size of the upper surface 121 of the polishing pad 120, and thus the area size of the upper surface 111 of the platen body 110, can be determined by the area size of the substrate W to be polished.

With a small size of the chemical-mechanical polisher beneficial from a small size of the platen body 110, there can be a high flexibility for the arrangement of the production line of a polishing unit. Apart from the traditional linear mode of tool configuration, the small size of the chemical-mechanical polisher constructively allows a compact tool configuration as a cluster mode.

In the cluster mode, different processing chambers are put together in an array arrangement such that the openings of the different processing chambers are pointed towards the center of the array. During operation, the workpiece can be allocated into the different processing chambers, for example, by a delivery mechanism at the center of the array. This configuration of the chambers is regarded as a compact tool configuration. This cluster mode of compact tool configuration allows a flexible adjustment of the processing sequences of the workpiece. For example, if the workpiece has finished with the fifth process and it is arranged to go back to the first process, the delivery mechanism will just deliver the workpiece from the chamber of the fifth process directly to the chamber of the first process, without passing by the chambers for the fourth, the third and the second processes. In this way, different working processes can be repeated effectively in this cluster mode of compact tool configuration.

On the other hand, for the traditional linear mode of tool configuration, the different processing chambers are put together in a linear arrangement. If a workpiece is arranged to go back to a certain processing chamber which is a few steps of processes backwards, the workpiece will be delivered for a long way in order to reach this previous processing chamber. For example, if the workpiece has finished with the fifth process and is arranged to go back to the first process, the workpiece will be delivered from the chamber of the fifth process to the chamber of the first process, while the chambers for the fourth, the third and the second processes will be passed by. In case numerous workpieces are arranged to go back to the pervious processing chambers, the cost and time of the production will be significantly increased. If a complicated sequence of the working processes is employed and repeated working processes are involved, the efficiency for the traditional linear mode of tool configuration will be obviously lower than that of the cluster mode of compact tool configuration.

The fountain slurry supplier 130 supplies slurry up onto the upper surface 121 of the polishing pad 120. The fountain slurry supplier 130 includes a plurality of supplying arms 133. The supplying arms 133 fluidly communicate with the nozzles 131, and the nozzles 131 are substantially arranged along the supplying arms 133. Depending on the area size of the polishing pad 120, the quantity of the supplying arms 133 and the length of each of the supplying arms 133 can be adjusted. Subsequently, the number of nozzles 131 arranged along the supplying arms 133 can also be adjusted. The supplying arms 133 intersect at a reference point RP visible on the upper surface 111 of the platen body 110.

As shown in FIG. 2, three of the supplying arms 133 intersect at the reference point RP visible on the upper surface 111 of the platen body 110. With this reference point RP, the polishing pad 120 can be disposed on the upper surface 111 of the platen body 110 with an accuracy by making a reference point on the polishing pad 120 substantially matching with the reference point RP. In some embodiments of the present disclosure, the reference point RP is located substantially at the center of the upper surface 111 of the platen body 110. In the case that the reference point RP is located substantially at the center of the upper surface 111 of the platen body 110, the polishing pad 120 can be disposed on the upper surface 111 of the platen body 110 in a state where a center of the polishing pad 120 substantially matches with the reference point RP.

As shown in FIG. 2, the fountain slurry supplier 130 is at least partially embedded in the platen body 110, and the nozzles 131 protrude from the upper surface 111 of the platen body 110. To allow the polishing pad 120 to be disposed flat on the upper surface 111 of the platen body 110, the polishing pad 120 has at least one through hole $H_F$ therein, and the fountain slurry supplier 130 has at least one nozzle 131 in the through hole $H_F$ of the polishing pad 120.

When the polishing pad 120 is disposed on the upper surface 111 of the platen body 110, the nozzles 131 can also act as additional reference points. The reason is that the nozzles 131 pass through the respective through holes $H_F$ during the disposal. As the positions of the through holes $H_F$ are fixed on the polishing pad 120 and the positions of the nozzles 131 are fixed on the upper surface 111 of the platen body 110, this interaction between the through holes $H_F$ and the nozzles 131 can further increase the location accuracy when the polishing pad 120 is disposed on the upper surface 111 of the platen body 110.

As shown in FIGS. 1 & 2, the upper surface 121 of the polishing pad 120 faces away from the upper surface 111 of the platen body 110. The polishing pad 120 has at least one groove G in the upper surface 121 of the polishing pad 120. The grooves G fluidly communicate with the through holes $H_F$. The arrangement of the grooves G facilitates the flow and spread of the slurry over the polishing pad 120.

To facilitate the flow and spread of the slurry over the polishing pad 120 along the radial direction $D_R$, the upper surface 121 of the polishing pad 120 has at least one radial direction substantially parallel with the radial direction $D_R$. At least one of the grooves G extends substantially along the radial direction of the upper surface 121 of the polishing pad 120, i.e. the radial direction $D_R$. In some embodiments of this disclosure, as shown in FIGS. 1 & 2, six of the grooves G extend substantially along the radial directions of the upper surface 121 of the polishing pad 120, i.e. the radial directions $D_R$.

Moreover, in some embodiments of this disclosure, the through holes $H_F$ are located at bases of the grooves G, and the grooves G extend substantially along the radial directions of the upper surface 121 of the polishing pad 120, i.e. the radial directions $D_R$. As shown in FIGS. 1 & 2, four of the through holes $H_F$ are located at the base of one of the grooves G which extend substantially along the radial directions of the upper surface 121 of the polishing pad 120, i.e. the radial directions $D_R$.

After the polishing pad 120 is disposed on the upper surface 111 of the platen body 110, the nozzles 131 of the fountain slurry supplier 130 protrude from the respective through holes $H_F$ of the polishing pad 120 at protruding heights. Meanwhile, the depths of the grooves G are greater than the respective protruding heights. That is, the nozzles 131 do not protrude from the upper surface 121 of the polishing pad 120, and more specifically do not protrude from the respective grooves G. In this way, the nozzles 131 will not get into direct contact with the substrate W during the operation of the chemical-mechanical polisher, and the damage of either the substrate W or the nozzles 131 is avoided.

In some embodiments of this disclosure, the upper surface 121 of the polishing pad 120 has at least one circumferential direction $D_C$, and at least one of the grooves G extends substantially along the circumferential direction $D_C$ of the upper surface 121 of the polishing pad 120. This arrangement facilitates the flow and spread of the slurry over the polishing pad 120 along the circumferential direction $D_C$. As shown in FIGS. 1 & 2, four of the grooves G extend substantially along the circumferential directions $D_C$ of the upper surface 121 of the polishing pad 120.

In some embodiments of this disclosure, as shown in FIGS. 1 & 2, the through holes $H_F$, and thus the nozzles 131, are respectively located at the junctions of the grooves G extending substantially along the radial directions of the upper surface 121 of the polishing pad 120, i.e. the radial directions $D_R$, and the grooves G extending substantially along the circumferential directions $D_C$. Therefore, the slurry can flow and spread through the nozzles 131 to both the grooves G extending substantially along the radial directions of the upper surface 121 of the polishing pad 120, i.e. the radial directions $D_R$ and the grooves G extending substantially along the circumferential directions $D_C$.

When the slurry is supplied from the fountain slurry supplier 130, the slurry comes out from the nozzles 131 protruding from the through holes $H_F$. Since the grooves G fluidly communicate with the through holes $H_F$, and the through holes $H_F$, and thus the nozzles 131, are located at the junctions of the grooves G extending substantially along the radial directions of the upper surface 121 of the polishing pad 120, i.e. the radial directions $D_R$, and the grooves G extending substantially along the circumferential directions $D_C$, the slurry will flow and spread along the grooves G after coming out from the nozzles 131. The grooves G extending substantially along the radial directions of the upper surface 121 of the polishing pad 120, i.e. the radial directions $D_R$, facilitate the flow and spread of the slurry along the radial directions $D_R$. This forms a good foundation to the even distribution of the slurry over the upper surface 121 of the polishing pad 120. Furthermore, as the nozzles 131 are aligned with the grooves G in the circumferential directions $D_C$, the rotation of the platen body 110 together with the polishing pad 120 facilitates the flow and spread of the slurry along the grooves G in the circumferential directions $D_C$. As a result, an even distribution of the slurry over the polishing pad 120 can be achieved.

Figure 3:
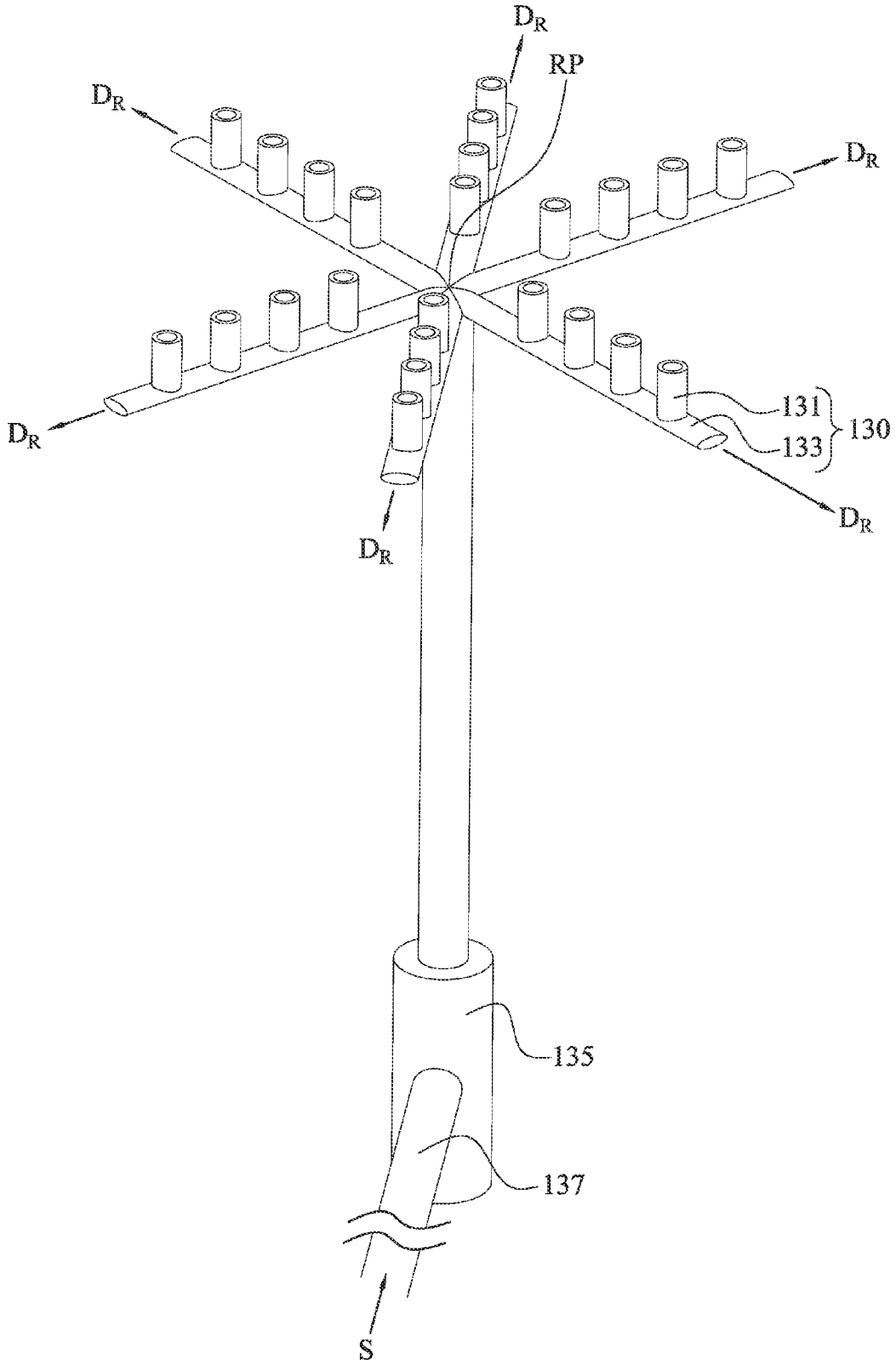
FIG. 3 is a schematic 3-dimensional drawing of the fountain slurry supplier 130 of FIG. 1.

FIG. 3 is a schematic 3-dimensional drawing of the fountain slurry supplier 130 of FIG. 1. In some embodiments of this disclosure, as shown in FIG. 3, the slurry is supplied from a slurry source S. In order to supply the slurry from the slurry source S to the fountain slurry supplier 130 while the fountain slurry supplier 130 is rotating with the platen body 110 during the operation of the chemical-mechanical polisher, the chemical-mechanical polisher further includes a rotary jointer 135. The rotary jointer 135 connects the fountain slurry supplier 130 to a slurry pipe 137, while the slurry pipe 137 is connected to the slurry source S. The rotary jointer 135 is a joint which is well sealed. The rotary jointer 135 plays the role as a bridge to connect the rotating fountain slurry supplier 130 and the static slurry pipe 137 and thus the slurry source S. Depending on the actual arrangement, the quantity and the length of the slurry pipe 137 can be adjusted. In addition, the rotary jointer 135 allows the slurry supplied from the slurry source S to flow to the fountain slurry supplier 130 while the fountain slurry supplier 130 is rotating with the platen body 110 during the operation of the chemical-mechanical polisher.

Reference is made to FIGS. 1 & 2. The chemical-mechanical polisher further includes a detector 140 for detecting a state of the substrate W. The detector 140 is at least partially disposed on the upper surface 111 of the platen body 110. In some embodiments of this disclosure, as shown in FIG. 2, two of the detectors 140 are substantially embedded in the platen body 110, and the two detectors 140 are located along the same diameter with the center of the platen body 110 equally in the middle. The detector 140 includes at least one detector head 143, and the detector head 143 is exposed from the platen body 110.

Furthermore, the polishing pad 120 has at least one transparent region TR exposing the detecting head 143. In some embodiments of this disclosure, as shown in FIG. 2, the position of the transparent region TR on the polishing pad 120 correspondingly matches with the position of the detector 140 as embedded in the platen body 110. To be more specific, two of the transparent regions TR are located along the same diameter on the polishing pad 120 with the center of the polishing pad 120 in the middle, with the positions of the transparent regions TR on the polishing pad 120 correspondingly match with the positions of the two detectors 140 as embedded in the platen body 110. In this way, when the polishing pad 120 is disposed on the upper surface 111 of the platen body 110, the detecting head 143 is exposed through this transparent region TR.

In some embodiments of this disclosure, the detector 140 includes an infrared (IR) image sensor, a laser detector, an eddy-current detector, or any combination thereof. The transparent region TR can be made of a material which is correspondingly transparent to the detecting signal transmitted to or from the detector 140. For example, the material of the transparent region TR is transparent to IR light in the case that the detector 140 is the IR image sensor.

When the chemical-mechanical polisher is in use, the detector 140 can detect the state of the substrate W. Then, a profile of the substrate W can be tuned in-situ according to the detected state of the substrate W.

In the case that the detector 140 is the IR image sensor, the detector 140 can detect the surface temperature of the substrate W and instantly pass the feedback to a control center. In this way, the thickness of the substrate W can be obtained in-situ, and the profile of the substrate W can be instantly tuned by the adjustment of the pressure of the carrier head 150 exerted against the upper surface 121 of the polishing pad 120.

Technically speaking, the detector head 143 can be as long as the radius of the substrate W. Under this condition, the range of the detection can cover the whole area of the substrate W. Therefore, the monitor of the topography over the whole area of the substrate W can be achieved.

In some embodiments of the present disclosure, at least one of the detectors 140 includes at least one detecting arm 141 connected to the detecting head 143. The detecting arm 141 is arranged substantially along the radial direction $D_R$ of the upper surface 111 of the platen body 110. The detecting arm 141 and at least one of the supplying arms 133 intersect at the reference point RP visible on the upper surface 111 of the platen body 110. Similar to the reference point RP as aforementioned at which the supplying arms 133 intersect, the polishing pad 120 can be put with an accuracy by making a reference point on the polishing pad 120 substantially matching with the reference point RP.

In some embodiments of this disclosure, the platen assembly includes the platen body 110, the polishing pad 120 and the fountain slurry supplier 130. The platen body 110 has the upper surface 111. The polishing pad 120 is disposed on the upper surface 111 of the platen body 110. The fountain slurry supplier 130 is at least partially disposed on the upper surface 111 of the platen body 110 for supplying slurry up onto the upper surface 121 of the polishing pad 120.

In some embodiments of this disclosure, the chemical-mechanical polisher includes the platen body 110, the polishing pad 120, the fountain slurry supplier 130 and the carrier head 150. The platen body 110 has the upper surface 111. The polishing pad 120 is disposed on the upper surface 111 of the platen body 110, and the polishing pad 120 has an upper surface 121 facing away from the upper surface 111 of the platen body 110. The fountain slurry supplier 130 is at least partially disposed on the upper surface 111 of the platen body 110 for supplying slurry up onto the upper surface 121 of the polishing pad 120. The carrier head 150 is disposed over the polishing pad 120 for holding a substrate W against the upper surface 121 of the polishing pad 120.

In some embodiments of this disclosure, a method for polishing the substrate W includes supplying slurry up onto the upper surface 121 of the polishing pad 120 by the fountain slurry supplier 130, holding the substrate W against the upper surface 121 of the polishing pad 120, and rotating the polishing pad 120, the fountain slurry supplier 130 and the substrate W.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims is not intended to invoke the provisions of 35 U.S.C. §112, 6th paragraph.

What is claimed is:

1. A platen assembly, comprising:

a platen body having an upper surface;

a polishing pad disposed on the upper surface of the platen body and the polishing pad having at least one through hole therein; and a fountain slurry supplier at least partially disposed on the upper surface of the platen body for supplying slurry up onto the polishing pad, the fountain slurry supplier having at least one nozzle protruding from the through hole of the polishing pad wherein the fountain slurry supplier comprises at least one supplying arm at least partially visible on the upper surface of the platen body.

2. The platen assembly of claim 1, wherein the upper surface of the platen body has at least one radial direction, and the fountain slurry supplier has a plurality of nozzles arranged substantially along the radial direction of the upper surface of the platen body.

3. The platen assembly of claim 1, wherein a plurality of the supplying arms intersect at a reference point visible on the upper surface of the platen body.

4. The platen assembly of claim 3, wherein the reference point is substantially at a center of the upper surface of the platen body.

5. The platen assembly of claim 1, wherein the polishing pad has an upper surface facing away from the upper surface of the platen body and at least one groove in the upper surface of the polishing pad, and the groove fluidly communicates with the through hole.

6. The platen assembly of claim 5, wherein the upper surface of the polishing pad has at least one radial direction, and the groove extends substantially along the radial direction of the upper surface of the polishing pad.

7. The platen assembly of claim 5, wherein the through hole is located at a base of the groove.

8. The platen assembly of claim 5, wherein the nozzle of the fountain slurry supplier protrudes from the through hole of the polishing pad at a protruding height, and a depth of the groove is greater than the protruding height.

9. The platen assembly of claim 5, wherein the upper surface of the polishing pad has at least one circumferential direction, and the groove extends substantially along the circumferential direction of the upper surface of the polishing pad.

10. The platen assembly of claim 1, further comprising:

a detector at least partially disposed on the upper surface of the platen body.

11. The platen assembly of claim 10, wherein the detector comprises at least one detecting arm, and the detecting arm of the detector and the supplying arm of the fountain slurry supplier intersect at a reference point visible on the upper surface of the platen body.

12. The platen assembly of claim 10, wherein the detector comprises at least one detecting head, and the polishing pad has at least one transparent region exposing the detecting head.

13. The platen assembly of claim 10, wherein the detector comprises an IR image sensor, a laser detector, an eddy-current detector, or any combination thereof.

14. The platen assembly of claim 1, further comprising:

a rotary jointer connecting the fountain slurry supplier to a slurry pipe.

15. A chemical-mechanical polisher, comprising:

a platen body having an upper surface;

a polishing pad disposed on the upper surface of the platen body, the polishing pad having an upper surface facing away from the upper surface of the platen body, and the polishing pad having at least one through hole therein;

a fountain slurry supplier at least partially disposed on the upper surface of the platen body for supplying slurry up onto the polishing pad, the fountain slurry supplier having at least one nozzle protruding from the through hole of the polishing pad; and a carrier head disposed over the polishing pad for holding a substrate against the upper surface of the polishing pad.

16. The chemical-mechanical polisher of claim 15, wherein the substrate has a polished surface against the upper surface of the polishing pad, and an area of the upper surface of the polishing pad substantially satisfies:

$$80\%\ A_{polishing\ pad} \leq A_{substrate} \leq 95\%\ A_{polishing\ pad},$$

where $A_{polishing\ pad}$ is the area of the upper surface of the polishing pad, and $A_{substrate}$ is an area of the polished surface of the substrate.

17. The chemical-mechanical polisher of claim 15, wherein the substrate has a polished surface against the upper surface of the polishing pad, and an area of the upper surface of the platen body substantially satisfies:

$$80\%\ A_{platen\ body} \leq A_{substrate} \leq 95\%\ A_{platen\ body},$$

where $A_{platen\ body}$ is the area of the upper surface of the platen body, and $A_{substrate}$ is an area of the polished surface of the substrate.

18. A method for polishing a substrate, comprising:

assembling a polishing pad onto a platen body with a fountain slurry supplier thereon, wherein at least one nozzle of the fountain slurry supplier is put into at least one through hole of the polishing pad;

supplying slurry up onto the polishing pad by the fountain slurry supplier;

holding a substrate against an upper surface of the polishing pad; and rotating the polishing pad, the fountain slurry supplier, and the substrate.

19. The method of claim 18, further comprising:

detecting a state of the substrate; and tuning a profile of the substrate in situ according to the detected state of the substrate.

* * * * *